United States Patent [19]

Held

[11] Patent Number: 4,485,733

[45] Date of Patent: Dec. 4, 1984

[54] ARRANGEMENT FOR THE SUPPORT OF PRESS BANDS AT ROLLER BODY SUPPORTED DOUBLE BAND PRESSES

[76] Inventor: Kurt Held, Alte Strasse 1, D-7218 Trossingen 2, Fed. Rep. of Germany

[21] Appl. No.: 466,885

[22] Filed: Feb. 16, 1983

[30] Foreign Application Priority Data

Feb. 27, 1982 [DE] Fed. Rep. of Germany ..... 3207156

[51] Int. Cl.[3] ..... B30B 5/06

[52] U.S. Cl. ..... 100/93 RP; 100/90; 100/154; 156/583.5; 425/371

[58] Field of Search ..... 100/151, 152, 153, 154, 100/118, 93 RP, 90; 156/555, 582, 583.1, 583.5; 425/371, 405 R

[56] References Cited

U.S. PATENT DOCUMENTS

| | | | |
|---|---|---|---|
| 2,459,295 | 1/1949 | Skoog | 100/93 RP X |
| 2,981,307 | 4/1961 | Malarkey, Jr. | 100/154 |
| 3,808,092 | 4/1974 | Busker | 100/154 X |
| 3,926,542 | 12/1975 | Ahrweiler | 425/371 X |
| 4,002,114 | 1/1977 | Guttinger | 425/371 X |
| 4,285,525 | 8/1981 | Held | 100/154 X |
| 4,311,550 | 1/1982 | Kerttula | 156/583.5 X |

*Primary Examiner*—Peter Feldman

*Attorney, Agent, or Firm*—Toren, McGeady and Stanger

[57] ABSTRACT

An arrangement for the support of press bands in double band presses includes a press band with a roller bed supporting the rear side of the press band. Seals are positioned between the roller bed and the rear side of the press band. A heating plate is disposed within said roller bed and is in spaced relation with the press band. Support-bearing bars are supported on the heating plate and extend between the heating plate and the rear side of the press band. Shafts extend through bores in the support-bearing bars and needle rollers are mounted on the shafts. The ends of the needle rollers in adjacent rows are offset. Filling elements are positioned within and fill out the hollow spaces between the rollers. The parts in the roller bed form rolling gaps, capillary gaps and support bearing gaps and these gaps are limited to a minimum and a lubricant is filled into the gaps. An equalizing space is located on the rear side of the press band over the entire area of the rôller bed and fluid pressure medium can act in the equalizing space on the press band. Further, a pressure chamber is located within the roller bed. With this arrangement the range of operationally safe, controllable surface pressures in double band presses is considerably expanded without omitting the advantages of the fluid cushion principle and the roller bed support, and it is possible to provide an isochoric, isobaric and combined operation for the manufacturing of pressed material of all types.

3 Claims, 1 Drawing Figure

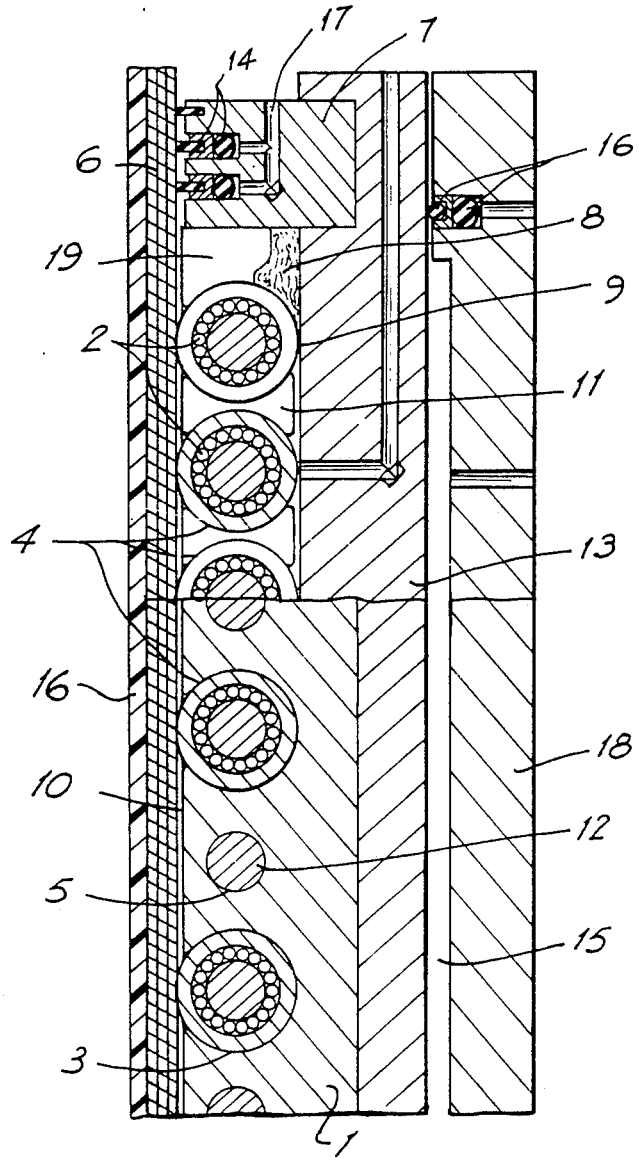
17
7
14
6
16
8
19
9
2
11
4
13
16
18
10
12
5
15
3
1

ARRANGEMENT FOR THE SUPPORT OF PRESS BANDS AT ROLLER BODY SUPPORTED DOUBLE BAND PRESSES

The invention is direct to an arrangement for the support of press bands at double band presses for exercising a surface pressure. The arrangement includes a roller bed with seals at the rear side of the pressure band. Needle rollers on shafts are located beween the rear side of the press band and a heating plate. Hollow spaces are located between the rollers and the space between the heating plate and the press band and the hollow spaces are filled with filling elements. Further, within the roller bed rolling gaps are provided between the rollers and the heating plate, capillary gaps are provided between the rollers and the filling elements, and support bearing gaps are provided between the rollers and the rear side of the press band. These various gaps are limited to a minimum determined by the manufacturing tolerances of the parts forming the gaps and the gaps are filled with lubricant.

Double band presses serve to exert a surface pressure on plate-shaped workpieces or on material webs which are guided continuously through the machine while adding or removing heat to or from the material to be pressed.

Such continuously operating double band presses permit, contrary to the discontinuously operating plate presses, the continuous movement of the material to be pressed and consequently overlapping of the pressing process and the transport process, but particularly they permit the exertion of surface pressure onto a material web of any choosen length.

To the extend that they have proven in the past to operate safely and continuously, the presses of the known type work either according to the fluid cushion principle (see German Pat. No. 2,737,629, German Auslegeschrift No. 2,722,262, U.S. Pat. No. 2,528 168) or according to the roller principle. The disadvantage of the fluid cushion machines is their high power requirement at higher pressures from approximately 200N/cm$^2$ as well as the existing necessity to cover the operating width and length completely with material to be pressed or to provide cushions which can be partially switched off and which are subject to failure. The disadvantage of the roller supported double band presses is the hertzian pressure which occurs between the supporting rollers and the press bands and which limits the operationally safe, controllable surface pressures to a range which is technically of little interest.

It is also disadvantageous that known fluid cushion double band presses only make possible isobaric pressing operation, while roller supported machines with a firmly installed roller bed permit only isochoric operation.

It has been found that one can improve the arrangement according to the patent application No. 31 35 031.3-14, i.e. that one can significantly expand the area of operationally safe, controllable surface pressures in double band passes, without having to give up the advantages of the fluid cushion principle or the roller supported principle and to suggest a press which permits, selectively and independently from one another by means of simple switching processes, isochroic or isobaric as well as a combined operation which is simultaneously isochoric and isobaric, and which provides the geometric properties of the machine structure for the respective isochoric, isobaric or combined processing of the material to be pressed in one structure and makes the machine suitable for universal use.

It was now found that by means of a special embodiment of the roller bed as a form-equalizing space and the arrangement of an additional pressure chamber according to the invention, the above-mentioned task can be solved.

The advantages which can be achieved with the invention reside in that by means of the combination according to the invention of partially known solutions of both functional principles of the fluid cushion pressure as well as the roller bed pressure are applied onto the material to be pressed whereby an increased total surface pressure during safe operation is achieved in double band presses equipped in this manner. For the selectively isochoric or isobaric operation of the double band press, the roller pressure or the fluid pressure may also be applied individually.

In the pressure chamber, a pressure is generated with the aid of a fluid pressure medium which acts via the support bearing bars of the roller bed on the rollers. Thereby this pressure is added to the pressure which is already applied mechanically on the roller bed. A surface pressure which acts on the press bands is generated in the form-equalizing space, also by means of a fluid pressure medium. Since the compressive force is a non-directional force nd acts in all directions, the pressure, transferred from the roller bed onto the press band by means of hertzian pressure, is reduced by this pressure prevailing in the equalizing space, i.e. the press band is again released. Consequently, the hertzian pressure, exercised by the roller bed, is held lower than the compression yield point of the press band which is determined by the material used. On the other hand, the surface pressure prevailing in the equalizing space acts also on the press band so that the total amount of pressure, provided by the hertzian pressure and the fluid pressure medium in the equalizing space, acts on the material to be pressed.

In order to guarantee the lubrication of all elements of the roller bed which slide against one another or roll off on one another, needle bushings with solid needles are arranged in rows, offset with respect to one another on common shafts, known per se, in such a way that their radial distances are merely large enough that the hollow spaces between the heating plate, the support, the press band and the needle bushings can be filled out with a shaped element which permits on the one hand the construction of gaps of equal, limited width between the heating plate, the support, the press band and the needle bushings and that the liquid lubricant can penetrate under capillary action, but which, on the other hand, guarantees due to its shape that it does not hinder the necessary rotary motions and sliding motions between the press band and the needle bushings.

When the machine with the roller bed is operated for instance inside a fluid cushion with oil as a pressure medium, according to the German Pat. No. 2 722 197 or 2 907 087, then the arrangement of filling elements can be omitted because the pressure medium guarantees lubrication.

If the machine is to be operated isochorically, then the fluid or gaseous pressure medium as well as the seals, necessary to maintain the pressure cushion, may be omitted if the liquid lubrication is maintained by replacing the drag losses which occured at the outlet of the roller bed.

For merely isobaric operation, the gap height of the machine is dimensioned in such a way that the rollers have no contact with the press bands and that merely the roller bed of the lower press band takes up any possible slack of the unit consisting of the band and the material to be pressed.

If the material to be pressed, for instance chip fleece for the production of chip plates or glass fiber fabric mats with copper foil for the preparation of printed circuit board laminates, requires combined isochoric-isobaric operation, then the different pressures, adapted to the material to be pressed, are set in the individual fluid cushions. For this purpose, the equalizing space which includes the entire roller bed and the pressure chamber are divided into individual fluid cushions which are acted upon independently with pressure and are sealed with respect to one another.

An embodiment of the invention is shown in side sectional view in the drawing.

The needle rollers 2 which are usually arranged in rows, parallel to the advancing direction of the press bands 6 between support bearing bars 1 on support shafts 12 are thereby offset with respect to one another by half the roller width so that each second support bearing bore 5 is replaced with an opening 3 which is dimensioned greater by the capillary gap height 4 than the diameter of the needle roller 2. At support bearing bars 1, adjacent in the transverse direction, bearing bore 5 and opening 3 are longitudinally offset to one another in the band advancing direction so that always between two bearing bores 5 installed needle rollers 2 are located offset in the transverse direction. The hollow space between two needle rollers 2 is filled out by means of a filling element 11 in such a way that, with respect to adjacent needle rollers 2, the heating plate 13 and the therein attached support bearing bars 1, gaps with a suitably dimensioned capillary gap height 4 result into which liquid or semi-liquid lubricants 8 enter under capillary action.

If now at the inlet of the press bands 6 into the roller bed 7 liquid or semi-liquid lubricant is applied onto the band surfaces or also onto the roller surfaces of the first row of rollers, then the lubricant is transversely distributed by means of the rolling gap 9 and the remaining excess of always two adjacent needle rollers 2 is fed through the support bearing gap 10 to the center of the subsequent needle roller 2 in the band advancing direction where the described process is repeated. On the side facing away from the press band 6, an equalizing space 19 which extends over the entire roller bed 7 and can be acted upon with fluid pressure medium and a pressure chamber 15 with seals 16 are provided.

The equalizing space 19 is limited on top by the heating plate 13 and at the bottom by the press band 6. The pressure chamber 15 is limited at the bottom by the heating plate 13 and at the top by the cover 18. This makes it possible, in addition to or instead of the hertzian pressure, to exert a surface pressure onto the press band 6.

The fluid pressure medium, emerging from the equalizing space, is scraped from the press band with the aid of seals 14 and is collected. To ensure that the pressure medium cannot impair the material to be pressed, in the roller bed which closes the equalizing space there are installed bores 17 which are connected to negative pressure or vacuum and by means of which the emerging pressure medium is removed.

I claim:

1. An arrangement for the support of press bands on roller body supported double band presses for exercising a surface pressure comprising a press band having a front side to contact the material being pressed and an opposite rear side, a roller bed for supporting the rear side of said press band, seals positioned between said roller bed and the rear side of said press band, a heating plate is disposed in said roller bed and in spaced generally parallel relation with said press band, elongated support-bearing bars are supported on said heating plate and extend from said heating plate to adjacent the rear side of said press band, said support-bearing bars having bores therethrough extending transversely of the elongated direction thereof, shafts extending through said bores across said roller bed, needle rollers mounted on said shafts and extending through said bores, said needle rollers being arranged in rows on said shafts and being offset in the transverse direction, said rollers on adjacent said shafts being in spaced relation and forming hollow spaces therebetween and between said heating plate and the rear side of said press band, filling elements positioned within and filling out said hollow spaces, said rollers and said heating plate disposed in closely spaced relation forming a rolling gap therebetween, said rollers and said filling elements disposed in closely space relation forming a capillary gap therebetween, said rollers and the rear side of said press band disposed in closely spaced relation forming a support bearing gap therebetween, said rolling gaps, capillary gaps and support bearing gaps are limited to a minimum specified by the manufacturing tolerances of the parts forming the gaps, a lubricant filling said rolling gaps, capillary gaps and support bearing gaps, wherein the improvement comprises that an equalizing space is located between the rear side of said press band and within said roller bed and is arranged to be acted upon with fluid pressure medium, a cover located on the opposite side of said heating plate from said press band, and said cover and heating plate defining a pressure chamber therebetween, seals for sealing said pressure chamber, said equalizing space is completely enclosed by said roller bed which in addition serves for supporting said press band, said equalizing space being limited on opposite sides by said press band and said heating plate.

2. An arrangement according to claim 1, characterized in that said equalizing space and said pressure chamber are divided into fluid cushions which can be acted upon with pressure individually and are sealed with respect to one another.

3. An arrangement according to claim 1 or 2, characterized in that bores arranged to be connected to vacuum or negative pressure, are installed in communication with said seals in said roller bed which encloses said equalizing space.

* * * * *